United States Patent [19]

Johnston et al.

[11] Patent Number: 4,466,937

[45] Date of Patent: Aug. 21, 1984

[54] PRODUCTION OF VENETIAN MOSAIC SURFACES

[75] Inventors: Roy G. S. Johnston; Dennis F. Pavelin, both of Bristol, England

[73] Assignee: Wessex Mosaic Studies Ltd., Bristol, England

[21] Appl. No.: 425,615

[22] Filed: Sep. 28, 1982

[30] Foreign Application Priority Data

Oct. 8, 1981 [GB] United Kingdom ..... 8130478

[51] Int. Cl.[3] ..... B28B 1/16

[52] U.S. Cl. ..... 264/256; 264/139; 264/221; 264/246; 264/333

[58] Field of Search ..... 264/256, 139, 34, 245, 264/246, DIG. 31, 227, 221, 333, 219

[56] References Cited

U.S. PATENT DOCUMENTS

| | | | |
|---|---|---|---|
| 250,239 | 11/1881 | Hansen | 264/219 |
| 556,591 | 3/1896 | Taber | 264/219 |
| 2,147,770 | 2/1939 | Ford | 264/60 |
| 2,819,495 | 1/1958 | Krausz | 264/256 |
| 3,097,080 | 7/1963 | Weir | 264/256 |
| 3,306,956 | 2/1967 | Barnette | 264/246 |
| 3,378,617 | 4/1968 | Elmendorf | 264/256 |
| 3,496,264 | 2/1970 | Grant | 264/256 |
| 4,094,941 | 6/1978 | Manners et al. | 264/256 |
| 4,254,077 | 3/1981 | Fontana et al. | 264/256 |

FOREIGN PATENT DOCUMENTS

| | | |
|---|---|---|
| 266365 | 9/1927 | United Kingdom . |
| 1160558 | 8/1969 | United Kingdom . |
| 1170363 | 11/1969 | United Kingdom . |
| 1257301 | 12/1971 | United Kingdom . |
| 1263147 | 2/1972 | United Kingdom . |
| 1308306 | 2/1973 | United Kingdom . |
| 1344995 | 1/1974 | United Kingdom . |
| 1434807 | 5/1976 | United Kingdom . |
| 1543972 | 4/1979 | United Kingdom . |
| 2036839 | 7/1980 | United Kingdom . |

*Primary Examiner*—Donald E. Czaja
*Assistant Examiner*—Mary A. Becker
*Attorney, Agent, or Firm*—Larson and Taylor

[57] ABSTRACT

A panel with a Venetian mosaic or terrazzo surface is produced by providing a support surface with partitioning walls to separate areas of the desired design, placing colored chips in respective areas, and laying settable material (which may be of different colors in different areas) thereover. The set layer is removed, and the front face (formed on the support surface) is ground. The walls may be incorporated therein. They may be provided by means of sheet material in which the design is carved and which is adhered to the support surface.

10 Claims, 4 Drawing Figures

PRODUCTION OF VENETIAN MOSAIC SURFACES

BACKGROUND OF THE INVENTION

This invention relates to the production of Venetian mosaic or terrazzo surfaces, especially panels for forming floors and for mounting on walls. It may for example be used for the production of decorative surfaces.

The terrazzo technique is often used in making decorative floors. The conventional technique comprises laying a screed of cement, usually hydraulic (Portland) cement, and aggregate in situ on a concrete base. The aggregate usually consists of marble or granite chippings which are often consolidated by rolling before the cement has set. After the cement has set, its upper surface is ground and polished to expose some of the chippings. Both the cement and the chippings can be coloured, thereby producing a decorative effect.

To expose the surface of larger chippings a great deal of grinding is necessary, and obviously this is time consuming and expensive. Also, smaller chippings in the surface layer can be completely lost by grinding to expose the larger chippings. Thus, the pattern of the chippings which will be exposed on grinding (and therefore the overall decorative effect) cannot be predicted in advance of grinding, and there is therefore always a degree of uncertainty as to whether the desired decorative effect will result.

SUMMARY OF THE INVENTION

According to the present invention, we provide a method of making a Venetian mosaic or terrazzo surface, comprising laying a layer or a settable composition (such as a resin binder or cement) and aggregate over the upper surface of a support, allowing or causing the settable layer to set, and separating the set layer from the support, wherein a number of low walls are provided on the upper surface, which walls act to define a plurality of areas in the surface of the layer to be formed. In use, the undersurface of the settable layer thus exposed will form the terrazzo surface. Usually, this surface will subsequently be ground and/or polished.

It is possible to lay the settable composition and aggregate of differing colours in the various areas, in order to building up a desired picture. The low walls need not be straight, or of constant cross-section but can be shaped to produce any desired resulting aesthetic effect. Preferably, some chippings of the aggregate material are laid over the support before pouring over the settable composition and aggregate mixture, or just settable composition. This permits the accurate positioning of these chippings, so that they are in a desired position in the finished picture. To prevent these chippings from moving when the settable composition is poured over, desirably there is a layer of an adhesive over the support, which adhesive is releasable when the support is removed from the settable composition and aggregate layer when it is set.

A flexible mechanism, for example of plastics material, may be provided on the upper surface of the support, and the materials laid over it. Any adhesive layer, and any separators, are then provided on the upper surface of this membrane. When the settable composition has set, therefore, it can be simply lifted clear of the support together with the membrane, and the membrane is peeled from the panel.

Alternatively the support may be covered with a material which is impervious to settable composition (such as wax) or the support may be of a substance which can be destroyed in the subsequent grinding process (such as coated fibre board).

The support (and any flexible membrane) may be transparent, so that when the chippings and the settable composition layer are being laid on it, it can be supported clear of the ground and the picture can be viewed from beneath as it is being built up. A transparent support also permits a tracing or drawing of the desired picture to be placed beneath the support, so that it can be followed when laying the separators and the chippings and settable composition. The support is suitably a sheet of glass.

The separators can be of any conventional material for such separators such as non-ferrous metal strip.

In a preferred embodiment of the invention however, the designs are carved in suitable sheet material and the separators cast directly into the mould so created. The sheet material may be fixed with adhesive to the casting support and may subsequently be removed by dissolving with a suitable solvent after the separators are cast. This leaves the separators fixed to the casting support which facilitates the building up of the design.

An alternative way of manufacturing the separators is to carve the design in a material from which the separators can be released without damaging the mould. A suitable material would be wax. This method is convenient for a repeating design. Separators can also be cast in metal using conventional casting techniques and a pattern (e.g. in plaster) produced by one of the foregoing methods.

An alternative process for building up the panel is to carve parts of the design in a suitable sheet material fixed with adhesive to the casting support and cast these parts of the finished panel before removing the remaining sheet material (or further portions of it), and casting the remainder of the panel. This facilitates greater flexibility in the design.

After the settable composition and aggregate layer has set, a backing layer can be applied to build the panel up to a uniform thickness. This backing layer can contain suitable reinforcing material. The backing layer may also take the form of a building element (e.g. a wall or floor panel) resulting in the finished element having a decorative surface incorporated in it. The process may also be used for non-structural elements e.g. a bath or shower cubicle.

Although the support should be arranged generally horizontally, it is not essential that it should be flat. By use of an appropriately shaped support, made for example by casting, it is possible to produce relief images in the final decorative surface. The layer of adhesive may then be used to hold chippings in position on non-horizontal sections of the support. Using this technique, chippings can be laid on quite steep surfaces, which may be curved; e.g. to make the sides and bottom of a sunken basin, pond or bath.

Other decorative effects may be obtained by incorporating translucent separators or aggregate into the design and arranging the finished panel in relation to natural or artificial light sources so that certain parts transmit the light. Such panels could be manufactured with both surfaces polished so as to provide a dividing unit (e.g. like a window).

The invention also includes Venetian mosaic or terrazzo panels made by a method as described above.

In order that the invention may be more easily understood, some examples will now be described with reference to the accompanying drawings.

DESCRIPTION OF THE PREFERRED EMBODIMENTS

Figure 1:
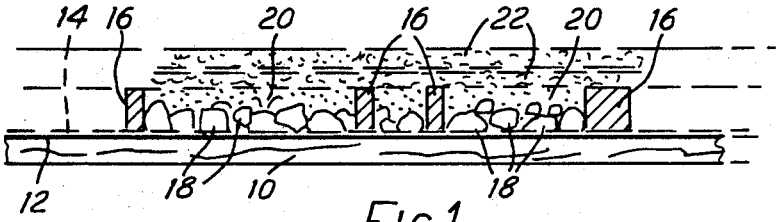
FIG. 1 is a cross-section through a flat terrazzo panel during formation.

Referring firstly to FIG. 1, a support 10 comprising a sheet of glass thick enough to support the necessary weight is arranged horizontally and spaced from the ground. A transparent flexible membrane 12, of plastics material (e.g. polyvinyl chloride) is laid over the upper surface of the support 10, and this membrane 12 is provided on its upper surface with a layer of a releasable pressure-sensitive adhesive 14. Conveniently, the membrane 12 and adhesive layer 14 are a commercially available self-adhesive sheet, such as that sold under the Trade Mark TRANSPASEAL which is supplied with a protective backing sheet which must first be removed. Atlernatively, a plain membrane 12 may be provided with a layer 14 of a spray-on pressure sensitive adhesive after it has been laid over the support 10.

Next, separators 16 are laid over the membrane, forming low walls which define various areas of a picture to be reproduced by the finished terrazzo surface. The separators may be cast from any of the materials conventionally used for such separators in terrazzo floors, for example brass, lead or a plastics substance. It is also possible to extrude separators in situ, or to make them of expanded polystyrene. These methods have the advantage that the separators can be formed to any desired shape, making it easy to create separators 16 of varying thicknesses in different parts of the picture. Where expanded polystyrene is used, the separators 16 are only temporary, as explained later.

Chippings 18 are then laid in desired positions against the adhesive surface of the membrane 12. The chippings can be of marble or granite, as conventional, or of other materials, such as chippings of a hard plastics, glass or gem stones. One of the advantages of the present method is that the chippings 18 can be laid precisely in any desired configuration, thus giving much greater control over the resulting finished pattern. However, where this is not important, this step can be omitted and the chippings 18 poured in with the cement in the next step; in this case the use of the adhesive 14 is not necessary. Neither are the separators 16 absolutely essential if a picture is not to be formed, though it will often be desirable to have some form of low wall around the very edge of the panel.

After the chippings 18 have been laid in the desired configuration, a mixture of cement and aggregate or just cement is poured over them in the various areas defined by the separators, to form a layer 20. The cement and the finer particles of aggregate will settle around the chippings 18. If the chippings 18 are not laid initially but are poured with the cement and aggregate mixture, the larger chippings will tend to sink towards the bottom, causing much the same effect, but giving less control over the final position of the chippings 18. Usually, different coloured chippings will be used in different areas of the panel, and also different coloured cement and aggregates will be used in different areas; the colour of the cement in any particular area can either match or contrast with the colour of the chippings 18 of that area.

The layer 20 need only be made as thick as the height of the separators 16. After this layer has been allowed to set, one or more further backing layers 22 are laid over it. The purpose of these backing layers is to provide strength and ridigity for the panel, and therefore preferably include some form of reinforcement. This may take the form of a steel mesh, and/or the layer or layers 22 may be made from glass reinforced cement. Obviously, it would be possible to make the layer 20 sufficiently thick that no reinforcing backing layers 22 were necessary, but this is not preferred since normally the layer 20 will consist of more expensive materials than is necessary for the backing layer. Also, by reinforcing the backing layer, it need not be as thick.

After all the cement has completely set, so that the panel is self-supporting, it can be removed from the glass support 10, together with the membrane 12 which is adhered to it. The membrane 12 is then peeled off to expose the front surface of the panel together with the chippings 18. This surface can then be ground and polished as desired. One advantage of the present method is that less grinding than normal would be required at this stage, since the decorative chippings 18 are all close to the exposed surface with their largest flat surfaces exposed, thus gaining maximum effect from any given chipping, or alternatively allowing the use of smaller chippings. This reduction in the amount of material needing to be ground off ensures that the layout of chippings by the designer is altered by the minimum amount. Also a saving in the amount of chippings 18 which need to be used is achieved, and since these chippings might be expensive this also results in a cost reduction.

It is also possible to prefabricate the panel, and then transport it to the place where it is to be laid. Obviously this is more convenient than fabricating a floor in situ. It also means that the finished panel need not be installed horizontally as a floor, but could be used, for example, as a decorative wall cladding.

Where the separators 16 are made from expanded polystryene, they will be removed after the surrounding mix has set, either by the application of heat to melt them or by the application of a suitable solvent. The crevices left behind can then be filled with coloured cement, or a mixture of cement and aggregate of any desired colour. It is thus possible to make the dividing lines between different areas of the picture of any desired colour, and by suitable shaping of the separators 16, it is also possible for these dividing lines to widen into areas of the picture in their own right if desired.

It is not essential that the support 10 and membrane 12 should be transparent, and the support 10 could be made of other materials and need not be raised from the ground. However, the use of a transparent support raised from the ground means that the pattern can be viewed from underneath as it is formed. It is also possible to draw a pattern for the desired picture first, for example on tracing paper, and place it either beneath the support 10, or sandwiched between the support 10 and the membrane 12, so that the pattern can be followed in laying the separators and chippings 18.

Figure 2:
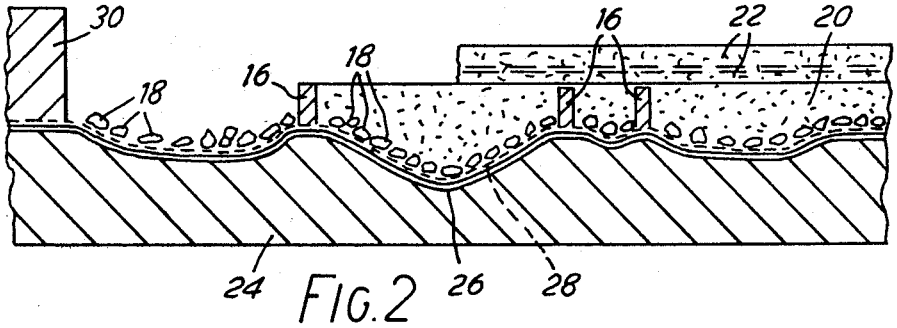
FIG. 2 is a similar view through another terrazzo panel, having images in relief, at various states of production.

FIG. 2 shows how a similar process can be used to produce a panel which has the final image in relief. Instead of a flat support 10, a support 24 is in the form of a female mould for the desired relief image. This mould is suitably cast from plaster of Paris, although other materials could be used. In place of the membrane 12, a layer 26 of a sealer for the plaster is sprayed over the upper surface of the cast. This material may also incorporate a release agent to facilitate subsequent removal of the finished panel. Over the layer 26, there is sprayed a layer 28 of pressure sensitive adhesive, which serves a similar purpose to the adhesive layer 14 in FIG. 1. The thickness of the layers 26,28 is somewhat exaggerated in FIG. 2. Separators 16 are then located as desired, and chippings 18 are laid on the adhesive layer 28. The adhesive holds the 18 in position on the non-flat surface. Next, a layer 20 of cement and aggregate is poured in, and after this has set further backing layers 22 can be formed on top of it, as desribed above in relation to FIG. 1. When the whole panel has set rigidly, the plaster cast can then be removed by chipping it away, and the resulting relief terrazzo surface can be ground and polished as before. Such a surface is useful for decorative wall cladding. As before, the chippings 18 and cement 20 can be of any desired colours.

The separators 16 can be of conventional materials, or can be temporary expanded polystyrene separators which are subsequently removed and the spaces left by them filled in, as described above.

The female plaster mould 24 can be made from a corresponding male mould made from expanded polystyrene. This is advantageous because of the ease with which polystyrene can be shaped. Also, the original male mould can either be fabricated in separate sections, or it can be cut up into suitably shaped sections. These sections can then be used (as shown by the section 30 in FIG. 2) in place of the separators 16 to surround a given area of the female mould 24 to act as a former when the cement and aggregate is poured into that area. After this has set, a section of the polystyrene male mould will be removed from a different section, and chippings 18 laid in that area and cement and aggregate of a desired contrasting colour poured into that area. It is thus possible to build up a composite picture without the use of separators 16. The resultant picture will therefore not have lines dividing the various areas. This technique could, of course, be used in a flat panel as well as in the relief panel of FIG. 2, by using sheets of expanded polystyrene or another material cut out to correspond to the various areas of the picture to be produced.

In both the above embodiments, hydrauic (Portland) cement is used. However, other settable compositions could be used, for example resins such as epoxy resin, or particulate thermoplastics which are heated and allowed to cool to coalesce.

Figure 3:
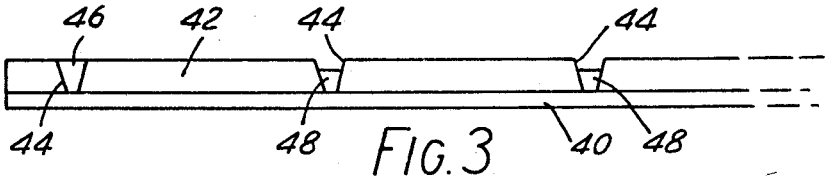
FIG. 3 is a similar view through a third panel at an early production stage.
Figure 4:
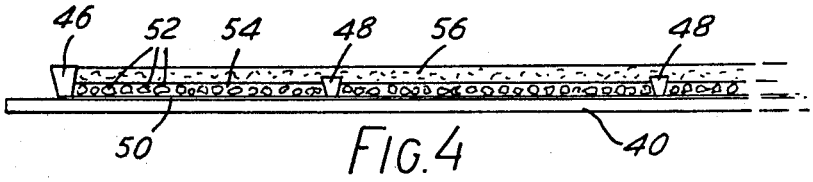
FIG. 4 shows the panel of FIG. 3 when completed.

Referring now to FIGS. 3 and 4; in a preferred method of manufacture, a base board 40 with a smooth, hard face is used. For example, a proprietory board with a plastics outer layer, such as of Melamine (Trade Mark), can be used. To the upper surface of this, there is glued a sheet 42 of expanded high density polystyrene, using a glue which might be a latex or water-based emulsion. The polystyrene layer 42 is suitably about ½" (13 mm) thick.

Next, a mirror image of the required design is drawn on the upper surface of the polystyrene layer 42. This can suitably be done by taking a pencil drawing of the desired design, laying it face down on the upper surface of the polystyrene layer 42, and rubbing over; or various types of carbon transfer, etc. may be used.

Then, grooves 44 are formed in the polystyrene layer 42, following the transferred pattern, using a V-shaped bit on a soldering iron to melt the polystyrene locally and carve out the design or a high speed cutter. Accordingly, the grooves 44 have a V-shaped profile. When this has been completed, the surface of the grooves 44 are brushed or sprayed with a water-based release agent, such as commonly used in glass fibre work.

Separators 46,48 are now cast in the grooves 44. The separators are cast from epoxy resin, which is poured into the grooves and allowed to set. Most of the grooves 44 need not be filled entirely, thus producing the somewhat lower separators 48 seen in FIG. 3. However, those grooves around the periphery of the required design are filled completely with the resin material, to give a somewhat higher peripheral wall 46. The epoxy resin of the separators can contain metal powders (which are very attractive), colourants, and can be opaque or translucent. If desired, other materials, e.g. thermoplastic or thixotropic materials, could be used for the separators.

When the separators 46,48 have set, the remaining polystyrene 42 is removed, either by breaking it out or by dissolving it away with a suitable solvent. The fact that the grooves 44 were coated with a release agent assists this removal process. This now leaves the resin separators 46,48 stuck to the base board 40.

The next step is to cover the base board between the separators with a wax release agent 50. Then, as in the embodiment of FIGS. 1 and 2, different coloured and sized marble chippings 52 are placed on the waxed surface, preferred side downwards, and the wax 50 will tend to keep them in position. In place of the cement mixtures used previously a resin layer 54 is now poured over and around the chippings 52. The resin may be clear, translucent, opaque, or mixtures of different resins may be used. In particular, different resins can be used in different areas separated by the separators 48.

The next stage is to build up layers on top of the resin layer 54. First of all, smaller chippings in matching colours will be poured on top of the layer. This is preferably but not essentially done before the resin 54 has had a chance to set, so that as much solid material is incorporated in the layer as possible. This resists any tendency which the resin might have to shrink. The upper layers 56 are formed by pouring in a mixture of sand and resin, which gives a hard, coarse backing.

When all the resin has set, the base board is removed. This can be done by pushing a trowel or other suitable implement under the slab, and the base board can then be pried off by reason of the wax release layer 50. Finally, as before, the front face of the slab (i.e. that which was closest to the base board 40) is ground, taking off perhaps 1–2 mm to expose the chippings 52. The back face is also ground to give a constant thickness to the slab.

If desired, the resulting slab can be divided into pieces to facilitate handling and laying. Where this is the intention, it is desirable to form larger separators 46 at the positions which are to be edges of the tiles, and to put a wax release coating on one side of this separator 46 to ease the separation.

Alternatively, the slab can be sectioned by cutting grooves in the back with a stone cutting saw or disc.

This is used to cut most of the thickness of the slab, which is then broken. The pieces thus formed can subsequently be put together again without the break showing.

If desired, the back of the slab can be reinforced with one or two layers of glass reinforced plastics, or metal. This is useful, for example, if the slab is to be used as a wall panel, rather than on a floor (where the foundation underneath the floor would naturally give overall support to the slab).

If a number of similar slabs are required, for example where a large area is to be covered with similar designs, the required design can be carved in a bed of wax in a plywood tray. The carving can be done either with heat or by mechanical cutting. The separators 46,48 are then cast in this tray with an epoxy resin or other suitable material, which should be non-brittle and non-shrinking. Before it sets, a few small metal loops are cast in the upper surface of the separators, to facilitate removal from the wax mould. When the separators 46,48 have set, they are lifted bodily from the wax, which is then ready for the casting of another set of separators. When there are as many sets of separators as required, they are temporarily glued to a Melamine base board (or more than one base board if necessary) which have been waxed as before. The procedure is then as described above with reference to FIGS. 3 and 4.

A further modification is possible to give a stained glass effect. For this, one should used tinted or clear separators, which should all be to the full depth of the polystyrene 42. The procedure which follows is then similar to that described with respect to FIG. 4, except that not only can opaque chippings 52 be used, but one can also use coloured glass chippings. The resin layer 54 can be either opaque or clear or tinted. The separators could if desired form letters and words, e.g. for advertising purposes. Of course it would be possible to use opaque separators in conjunction with clear or translucent resin layers 54 or chippings 52. Such a slab will give interesting effects when lit from behind.

A further modification is to produce a double-sided slab. To do this, after forming the slab as shown in FIG. 4, but before the upper layer 56 has set, further large, chippings 52 are laid on top. Before the resin sets, the top surface is rolled to settle these extra chippings 52 into the resin. After the entire slab has set, both sides are ground to expose the chippings. The middle layer of such a slab may comprise finer chippings, as before, which may be pre-mixed with the resin and pressed or rolled to bed them in. Alternatively, the middle layer may be a glass fibre reinforced plastics layer for strength.

The panels or slabs thus produced may have a variety of uses. As indicated above, their primary use is for flooring, or possibly wall panels. However, with the use of glass fibre reinforce techniques, decorative structural panels, such as decorative and semi-translucent roof lights, are perfectly possible.

The panels with unground backs can be laid face down in reinforced concrete casting moulds and incorporated into structural units. Translucent panels, polished both sides, can be incorporated into reinforced concrete structural units in one form of mullioned frames enclosing "stained glass" effect translucent panels.

It is also possible to incorporate such panels in various items, a table top for example. For such applications the repetitive moulding technique (using a wax mould for the separators 46,48 as described above) would reduce costs.

A further possibility is to cast rather thicker slabs, which can then be sliced into thinner slabs using a conventional single or multiple band saw (such as used for slicing marble blocks). For this, the chippings 52 are built up to a somewhat greater depth than would otherwise be the case, and the spaces between them filled with resin and smaller chippings as before. By making planar slices through the slab thus formed, a number of pictures (e.g. four) can be formed each of which differs slightly from the others, while having the same basic outline provided by the separators 46,48. As a further alternative, casting the unit with the larger chippings 52 towards the middle of the layers, and making a single slice through those middle layers would produce two units with mirror image patterns.

While the invention has been illustrated above by reference to the preferred embodiments, it will be understood by those skilled in the art that various changes may be made without departing from the spirit and scope of the invention, and it is intended to cover all such changes and modifications by the appended claims.

We claim:

1. A method of making a venetian mosaic or terrazzo surface having a pictorial design comprising a multiplicity of areas differing in color comprising:

(i) providing a support having an upper support surface;

(ii) delimiting at least a plurality of said areas of the design on said surface by a method comprising:

(a) locating a layer of sheet material on said surface, (b) providing on said sheet material a full-size representation of at least a first part of said pictorial design including said plurality of areas, (c) removing portions of the sheet material adjacent the peripheries of said areas to create channels extending through said sheet material to expose the support surface, said channels extending at least partially around respective areas, (d) casting separators onto the support surface in the channels so that the separators delimit the areas, and (e) removing the sheet material from the support surface within the delimited areas;

(iii) laying respective colored layers of settable composition and aggregate over said support surface in said delimited areas;

(iv) laying a backing layer to overlie said plurality of areas; and (v) removing the support to expose the front surface of the mosaic or terrazzo surface.

2. A method according to claim 1 wherein prior to laying the settable layers decorative chippings are laid on at least part of the support surface.

3. A method according to claim 1 wherein said chippings are temporarily adhered to the support surface.

4. A method according to claim 1 wherein the support surface is shaped so that the layer set thereon has a surface in relief.

5. A method according to claim 1 wherein said sheet material provides a male mould from which a female mould is cast to serve as said support, so that the layer set thereon has a surface of relief.

6. A method according to claim 1 wherein the support is at least in part transparent.

7. A method according to claim 1 wherein the set layer is laid face down in a mould and material is cast about it to produce a structural unit.

8. A method according to claim 1 in which the set layer is at least partially translucent, and the structural unit comprises a mullioned frame.

9. A method of making a venetian mosaic or terrazzo surface having a pictorial design comprising a multiplicity of areas differing in color comprising:

(i) providing a support having an upper support surface;

(ii) delimiting at least one first said area of the design on said surface by a method comprising:

(a) locating a layer of sheet material on said surface, (b) providing on said sheet material a full-size representation of at least a first part of said pictorial design including said at least one first area, (c) removing at least one portion of the sheet material to expose the support surface in the said at least one first area so that the remaining sheet material serves to delimit at least part of said area;

(iii) laying a respective colored layer of settable material and aggregate over said support surface in the at least one delimited area to create a first cast portion;

(iv) delimiting at least one further area adjacent said first cast portion by a method comprising removing at least one portion of the sheet material to expose the support surface in the at least one said further area so that said further area is delimited partly by sheet material still remaining and partly by the adjacent first cast portion;

(v) laying a respective colored layer of settable composition and aggregate over said support surface in the delimited further area to create a further cast portion;

(vi) laying a backing layer to overlie said plurality of areas; and (vii) removing the support to expose the front surface of the mosaic or terrazzo surface.

10. A method of making a venetian mosaic or terrazzo surface having a pictorial design comprising a multiplicity of areas differing in color comprising:

(i) providing a support having an upper support surface;

(ii) delimiting at least a plurality of said areas of the design on said surface by a method comprising:

(a) providing a layer of sheet material, (b) providing on said sheet material a full-size representation of at least a first part of said pictorial design including said plurality of areas, (c) removing portions of the sheet material adjacent the peripheries of said areas to define channels in said sheet material extending at least partially around each said area, (d) casting separators in said channels and removing the separators without damaging the sheet material, and (e) locating the separators on a further support surface to delimit said plurality of areas;

(iii) laying respective colored layers of settable composition and aggregate over said further support surface in said delimited areas;

(iv) laying a backing layer to overlie said plurality of areas; and (v) removing the further support to expose the front surface of the mosaic or terrazzo surface.

* * * * *